United States Patent [19]

Seaberg

[11] 4,337,836

[45] Jul. 6, 1982

[54] BULLDOZER LINKAGE

[75] Inventor: David H. Seaberg, Davenport, Iowa

[73] Assignee: J. I. Case Company

[21] Appl. No.: 191,476

[22] Filed: Sep. 26, 1980

[51] Int. Cl.[3] ..... E02F 3/76

[52] U.S. Cl. ..... 172/826

[58] Field of Search ..... 414/700, 697, 701, 710, 414/715, 917, 712; 172/824, 811, 826

[56] References Cited

U.S. PATENT DOCUMENTS

| | | | |
|---|---|---|---|
| 2,791,341 | 5/1957 | Michaels | 172/831 |
| 2,883,077 | 4/1959 | Pilch | 414/700 |
| 2,974,430 | 3/1961 | Bernotas | 172/824 |

*Primary Examiner*—Richard J. Johnson

*Attorney, Agent, or Firm*—Cullen, Sloman, Cantor, Grauer, Scott & Rutherford

[57] ABSTRACT

A linkage arrangement is disclosed for connecting a dozer blade and pushbeams which reduces blade roll-back during lifting thereby making it substantially more difficult for dirt and the like to cling to the blade. The linkage arrangement includes a pair of leveling link assemblies which are mounted to the pushbeams on opposite sides of the tractor frame. An adjustable strut is connected between one of the leveling link assemblies and the upper edge of the blade, and a tilt cylinder is connected between the upper edge of the blade and the opposed leveling link assembly. As the blade is raised, the adjustable strut and corresponding leveling link assembly automatically force the blade into a relatively vertical attitude thereby reducing blade roll-back. Actuation of the tilt cylinder permits the blade to be tilted while the blade is being kept at the vertical attitude established by the leveling link assembly and adjustable strut. Thus, the linkage arrangement forces the blade to a relatively vertical attitude during lifting to prevent blade roll-back while still permitting the blade to be tilted.

1 Claim, 3 Drawing Figures

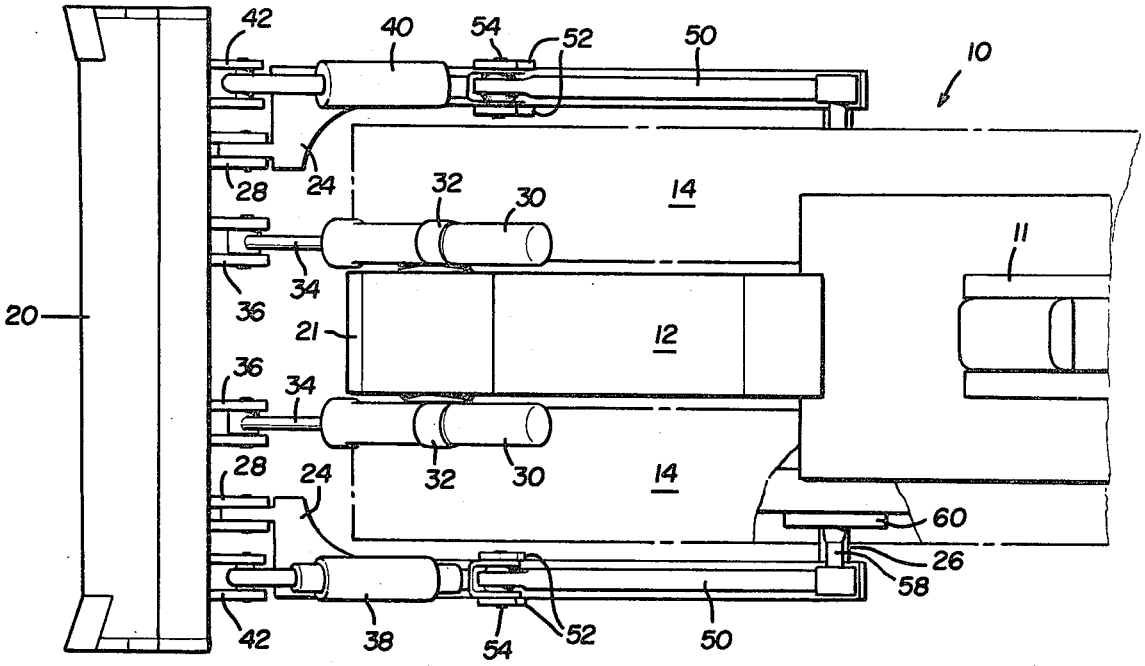
FIG. 1
FIG. 2
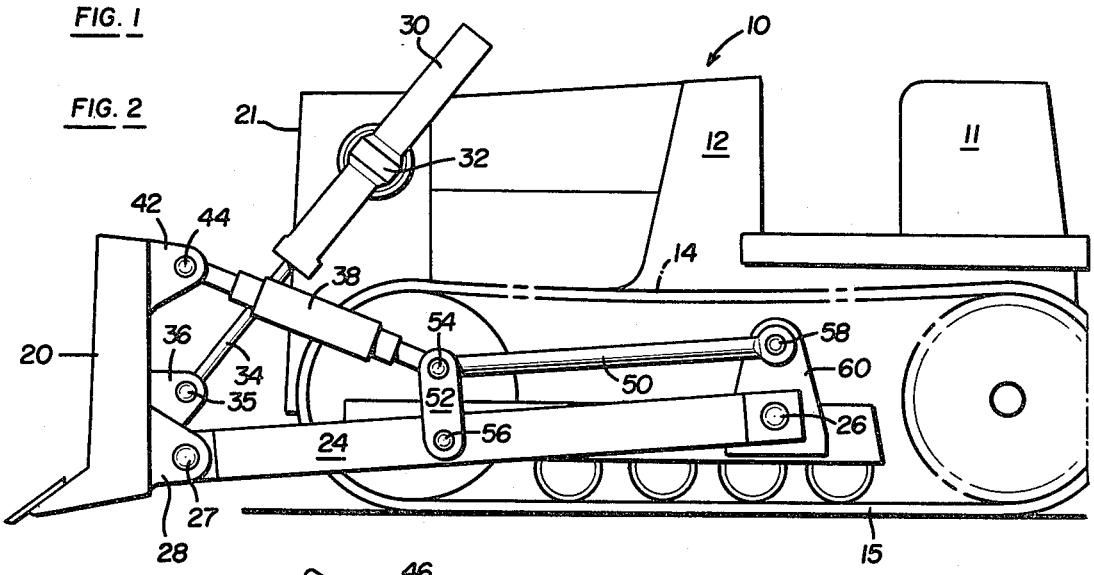
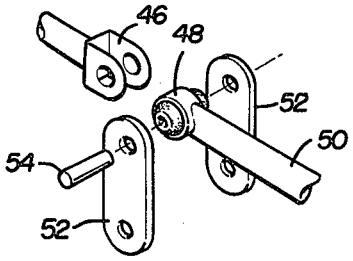
FIG. 3

BULLDOZER LINKAGE

BACKGROUND OF THE INVENTION

The present invention relates to bulldozers having transversely extending blades, and more particularly, to a linkage arrangement between the dozer blade and pushbeams which keeps the blade at a generally vertical attitude during lifting to prevent dirt and the like from clinging to the blade, particularly when working on an incline.

The blade of many earth-working vehicles is pivotally mounted forwardly of the front end of the main frame on pushbeams or push arms which extend rearwardly and flank the track frames. The pushbeams are pivotally connected to the track frames near the rear of the vehicle. A problem generally associated with such arrangements is that the upper edge of the blade angles rearwardly or rolls back towards the tractor as the blade is raised which permits dirt and the like to cling to the blade. This problem is especially acute when the blade is tilted for working on a slope because the dirt does not easily slide off the blade.

Thus, there has been a need for a mechanism between the blade and pushbeams that will keep the blade in generally vertical attitude during lifting while still permitting tilting of the blade. The disadvantages of present bulldozer constructions have resulted in the bulldozer linkage arrangement of the present invention which reduces the roll-back of the blade during lifting and tilting.

SUMMARY OF THE INVENTION

The linkage arrangement of the present invention may be utilized in a conventional bulldozer where the blade and pushbeams thereof form a substantially U-shaped structure. The bulldozer includes a conventional transverse scraper blade carried at the forward ends of laterally-spaced pushbeams which flank the track frames and are independently pivoted to the frames. The blade is raised and lowered by conventional hydraulic actuators supported on opposite sides of the engine housing and having piston rods pivotally connected to the back of the blade.

It is a principal object of the invention to provide a linkage arrangement connected between the dozer blade and the pushbeams which reduces blade roll-back during lifting thereby making it substantially more difficult for dirt and the like to cling to the blade. The geometry of the linkage arrangement is such that it pushes forward on the upper edge of the blade as the blade is raised to maintain the blade in a relatively vertical attitude during lifting. Additionally, the linkage arrangement permits the blade to be tilted while still performing the function of keeping the blade at a relatively vertical attitude during lifting.

In the preferred embodiment of the invention, the linkage connection between the blade and pushbeams includes a pair of leveling link assemblies mounted to the pushbeams on opposite sides of the tractor frame. An adjustable strut is connected between the upper end portion of one of the leveling link assemblies and the upper edge of the blade, and a tilt cylinder is connected between the upper edge of the blade and the upper end portion of the opposed leveling link assembly. Thus, as the blade is raised, the adjustable strut and corresponding leveling link assembly automatically force the blade into a relatively vertical attitude thereby reducing blade roll-back while the tilt cylinder is left in a float condition. Actuation of the tilt cylinder permits the blade to be tilted while the blade is being kept at the vertical attitude established by the leveling link assembly and adjustable strut.

The leveling link assembly is in the form of a parallelogram and includes a leveling link which is pivotally connected at one end to a mounting plate on the track roller frame and at its other end to the upper end of a pair of vertical support links which are pivotally connected at their lower end to a respective pushbeam. The leveling link is vertically spaced above the pushbeam and generally parallel thereto. The leveling link, support links, track mounting plate and that portion of the pushbeam between the support links and mounting plate form a parallelogram.

The adjustable strut is also connected to the upper end of the support links and when the blade is at ground level, the adjustable strut and leveling link form an obtuse angle. As the blade is lifted, the adjustable strut and leveling link move whereby the blade is forced into a relatively vertical attitude to reduce blade roll-back during lifting.

Other advantages and meritorious features of the bulldozer linkage taught by the present invention will be more fully understood from the following description of the preferred embodiment, the appended claims, and the drawings, a brief description of which follows.

BRIEF DESCRIPTION OF THE DRAWINGS

FIG. 1 is a top plan view of an earth-working vehicle embodying the invention.

FIG. 2 is a side elevational view of the earth-working vehicle embodying the invention.

FIG. 3 is a fragmentary detailed view of the connection between the leveling link and adjustable strut.

DETAILED DESCRIPTION OF THE INVENTION

A preferred embodiment of an earth-working vehicle including the bulldozer linkage made in accordance with the teachings of the present invention is illustrated in FIGS. 1–3. The tractor 10 shown in FIG. 1 is seen to include an operator's station generally indicated at 11 and a main frame 12 flanked by a pair of drive track frames 14. As is well-known, track roller assemblies may be provided on each of the track frames 14 for engaging track chains 15.

The bulldozer includes a conventional transverse scraper blade 20 mounted forwardly of the front end 21 of the frame 12. The blade 20 is carried at the forward ends of laterally spaced pushbeams 24 which flank the track frames 14 and are independently pivoted by universal joints 26 to mounting plates 60 on the conventional track roller frames 14. The blade 20 is secured to the pushbeams 24 by means of hinge connections including pins 27 and lugs 28 located near the lower end of the blade and on the backside thereof. As will be recognized by those skilled in the art, the hinge connections provide for mounting of the blade on the pushbeams 24 for movement about a horizontal transverse axis.

The blade 20 is raised and lowered by conventional hydraulic actuators or lift cylinders 30 supported on opposite sides of the engine housing by trunnion mountings 32 and having piston rods 34 pivotally connected by pins 35 to lugs 36 mounted to the back of the blade.

It is a principal object of the invention to provide a linkage arrangement connecting the dozer blade 20 and the pushbeams 24 which reduces blade roll-back during lifting thereby making it substantially more difficult for dirt and like to cling to the blade. As will be described, the geometry of the linkage arrangement is such that the blade is pushed forward to maintain a relatively vertical attitude during lifting. Additionally, the linkage arrangement permits the blade to the tilted while still keeping the blade at the relatively vertical attitude.

In the preferred embodiment of the invention, the linkage connection between the blade and pushbeams includes an adjustable strut 38, a tilt cylinder 40, and a pair of leveling link assemblies generally 50 which are mounted to the pushbeams 24 on opposite sides of the tractor frame.

Adjustable strut 38 and tilt cylinder 40 are connected by lugs 42 and ball joint connections 44 on opposed upper edge portions of blade 20. The opposite ends 46 (FIG. 3) of strut 38 and tilt cylinder 40 are pivotally connected by pins 54 to the ball joint ends 48 of leveling links 50. As the blade 20 is raised, the adjustable strut 38 and corresponding leveling link assembly generally 50 automatically force the blade 20 into a relatively vertical attitude thereby reducing blade roll-back while tilt cylinder 40 is left in a float condition. Actuation of tilt cylinder 40 permits the blade 20 to be tilted while the blade is being kept at the vertical attitude established by the leveling link assembly and adjustable strut 38.

The leveling link assembly is in the form of a parallelogram and includes a leveling link 50 which is pivotally connected at one end by pin 58 to mounting plate 60 on track roller frame 14. The other end 48 of leveling link 50 is pivotally connected by pin 54 to the upper ends of vertical support links 52. The lower ends of support links 52 are pivotally connected by pin 56 to a respective pushbeam 24. The leveling link 50 is vertically spaced above pushbeam 24 and generally parallel thereto. Leveling link 50, support links 52, track mounting plate 60, and that portion of pushbeam 24 between pin connection 56 and universal joint 26 form a parallelogram.

As illustrated in FIG. 2, when the blade 20 is at ground level, the adjustable strut 38 and leveling link 50 form an obtuse angle. As the blade is lifted, the adjustable strut 38 and leveling link 50 move whereby the blade 20 is forced into a relatively vertical attitude to reduce blade roll-back.

Tilt cylinder 40 may be actuated to tilt blade 20 while the blade is being kept at the vertical attitude established by the leveling link assembly and adjustable strut 38. When tilt cylinder 40 is extended outwardly, a downward push is exerted on pushbeam 24 through links 52 which forces the right-hand end of blade 20, as viewed from the operator's station 11, down and thus the blade cuts deeper on the right end. Conversely, when tilt cylinder 40 is retracted, an upward pull is exerted on pushbeam 24 through links 52 which forces the left end of blade 20, as viewed from the operator's station 11, down and thus the blade 20 cuts deeper on the left end.

It will be apparent to those skilled in the art that the foregoing disclosure is exemplary in nature rather than limiting, the invention being limited only by the appended claims.

I claim:

1. In an earth-working vehicle having a frame and a transverse blade at the forward end thereof, a pair of spaced apart pushbeams each pivotally secured at one end on opposed sides of said vehicle to track frames and said beams pivotally secured to said blade at their opposed ends, the improvement comprising:

a leveling link assembly for each pushbeam, each leveling link assembly including a mounting plate connected to one of said track frames, one of said pushbeams being pivotally mounted to said mounting plate, a leveling link pivotally mounted at one end to said mounting plate, said leveling link being vertically spaced above said pushbeam and generally parallel thereto, the other end of said leveling link being pivotally connected to support links which are pivotally connected to said pushbeam, said leveling link, support links, mounting plate, and pushbeam forming a parallelogram;

an adjustable strut pivotally connected at one end to the support links of one of said leveling link assemblies and at its other end to an upper corner of said blade; and a tilt cylinder pivotally connected between the support links of the other leveling link assembly and another upper corner of said blade whereby said adjustable strut and tilt cylinder force said blade into a relatively vertical attitude upon said blade being raised to thereby reduce blade roll-back and actuation of said tilt cylinder causing tilting of said blade while said blade is being kept at said relatively vertical attitude.

* * * * *